United States Patent [19]

Yates

[11] 4,109,877

[45] Aug. 29, 1978

[54] WINDING APPARATUS

[75] Inventor: Stephen William Yates, Bolton, England

[73] Assignee: Platt Saco Lowell, Helmshore Rossendale, England

[21] Appl. No.: 783,949

[22] Filed: Apr. 1, 1977

[30] Foreign Application Priority Data

Apr. 7, 1976 [GB] United Kingdom ..... 14050/76

[51] Int. Cl.[2] ..... B65H 75/16

[52] U.S. Cl. ..... 242/54.4; 242/18 A; 242/25 A

[58] Field of Search ..... 242/54.4, 25 A, 18 A

[56] References Cited

U.S. PATENT DOCUMENTS

| | | | |
|---|---|---|---|
| 2,600,037 | 6/1952 | West | 242/54.4 |
| 3,148,841 | 9/1964 | Hollingsworth | 242/25 A |
| 3,701,491 | 10/1972 | Brown | 242/25 A |
| 3,768,751 | 10/1973 | Brown | 242/25 A |

*Primary Examiner*—Edward J. McCarthy
*Attorney, Agent, or Firm*—Watson, Cole, Grindle & Watson

[57] ABSTRACT

Apparatus is disclosed for winding an elongate fibrous material comprising package tube mounting means to support first and second package tubes in winding positions in transversely spaced parallel relationship, a material delivery arm for delivering material first to one of the package tubes to form a first package and then to the other of the package tubes to form a second package, and variable speed drive means for rotating the package tubes. The variable speed drive means comprises a first output drive member for driving one of the package tubes, a second output drive member for driving the other of the package tubes, a constant speed input member, a drive transfer mechanism for transmitting drive from the input member to the output drive members throughout a predetermined range of complementary drive ratios and control means responsive to a predetermined control input progressively to adjust the drive transfer mechanism to vary the complementary drive ratios in such range to produce a gradual reduction in speed of one of the two output drive members with a corresponding increase in the speed of the other output drive member followed by a gradual reduction in speed of the other of the two output drive members with a corresponding increase in the speed of the one of the output drive members.

9 Claims, 4 Drawing Figures

WINDING APPARATUS

This invention relates to apparatus for winding elongate material into packages and particularly although not exclusively to apparatus for winding fibrous textile material in the form of sliver or roving.

When winding sliver or roving into packages, the packages build up very quickly because of the relatively large bulk of the material being would. It is therefore desirable to provide a winding apparatus in which transfer of winding material from a full package to an empty package tube can take place with a minimum of delay.

In U.S. Ser. No. 790,877 commonly owned herewith there is described apparatus for winding roving in which package tube mounting members support first and second package tubes in winding position in transversely spaced parallel relationship. A roving delivery arm is provided for delivering roving first to one of the package tubes to form a first package and then to the other of the package tubes to form a second package. The package tubes are required to rotate at predetermined variable speeds for winding on the roving at a constant winding-on speed and the delivery arm is required to traverse in the direction of the axis of rotation of the tube for building a parallel-build package on each tube. During the building of each package, the arm is furthermore required to be displaced in a direction perpendicular to the axis of rotation of the tubes to accommodate the increasing diameter of the package being built on the tube.

It is an object of the present invention to provide a drive system for driving the package tubes at appropriate variable speeds, for traversing the delivery arm in the direction of the package tube axes to produce parallel-build packages and for displacing the delivery arm in a direction at right angles to the package tube axes to take account of the increases in diameter of the packages being built.

According to the present invention, there is provided apparatus for winding an elongate fibrous material comprising package tube mounting means to support first and second package tubes in winding positions in transversely spaced parallel relationship, a material delivery arm for delivering material first to one of the package tubes to form a first package and then to the other of the package tubes to form a second package, and variable speed drive means for rotating the package tubes, said variable speed drive means comprising a first output drive member for driving one of the package tubes, a second output drive member for driving the other of the package tubes, a constant speed input member, a drive transfer mechanism for transmitting drive from said input member to the output drive members throughout a predetermined range of complementary drive ratios and control means responsive to a predetermined control input progressively to adjust the drive transfer mechanism to vary the complementary drive ratios in said range to produce a gradual reduction in speed of one of the two output drive members with a corresponding increase in the speed of the other output drive member followed by a gradual reduction in speed of the said other of the two output drive members with a corresponding increase in the speed of the said one of the output drive members.

The control means of the variable speed drive means may simply be arranged to provide for a constant rate of change of speed of the output drive members throughout the range of drive ratios. For some applications, however, it may be desirable to arrange for the control means to provide for a predetermined variation in the rate of change of speed of the output drive members within the range of drive ratios.

The constant speed input member of the variable speed drive means may conveniently comprise a cylindrical drive roller, while the drive transfer mechanism may comprise a pair of cone pulleys arranged in transversely spaced parallel relationship with the smaller diameter of each opposite the larger diameter of the other and a belt passing in driven contact with the drive roller and in driving contact with the two cone pulleys.

In a preferred embodiment of the invention first and second traversing means are provided. The first traversing means causes relative traversing movement between each package tube and the delivery arm in the direction of the axis of rotation of the tube for building a parallel-build package on the tube, is drivably connected to one of the output drive members of the variable speed drive means during the build of a package on one of the package tubes and is drivably connected to the other of the output drive members of the variable speed drive means during the build of a package on the other of the package tubes. The second traversing means is operative during the building of each package to cause in a direction perpendicular to the axes of rotation of the tubes a relative displacement between the delivery arm and the package tube to accommodate the increasing diameter of the package being built on the tube and is drivably connected to the control means of the variable speed drive means.

The delivery arm in a preferred construction is supported by support means, the second traversing means comprises first displacement means for displacing the support means progressively first in one direction to cause the delivery arm to build a package on one of the tubes and then in the opposite direction to cause the delivery arm to build a package on the other of the tubes, and second displacement means are provided responsive to completion of a package on each of the tubes to cause further displacement of the support means to bring the arm to bear against the other package tube to effect transfer to the said other package tube of the material delivered by the delivery arm.

The delivery arm in the preferred construction is arranged during the building of a package to contact the package at a winding-on point which lies in a plane containing the axes of rotation of the two package tubes and to deliver material at the winding-on point direct to the package under a winding tension localised in the region of the winding-on point by the delivery arm and the first displacement means is operative during the building of each package to maintain the winding-on point in said plane.

Preferably, the delivery arm is pivotally suspended from arm support means and said displacement of the support means by said first displacement means during the build of each package is such as to maintain the delivery arm in a substantially vertical disposition throughout the build of a package on each tube. The arm support means is then arranged during said further displacement by the second displacement means to move beyond the position in which the delivery arm is vertical and contacts the said other package tube, thereby to incline the arm and cause it to bear against the periphery of the tube. Preferably, the arrangement is such that the delivery arm at the completion of a package on one of the tubes almost contacts the surface of the other tube.

The delivery arm may be of generally cylindrical form and the material guided to the winding-on point in a plurality of turns around the cylindrical portion of the arm. The arm is furthermore preferably made symmetrical with respect to a plane passing through the longitudinal axis of the arm and includes an end portion adapted to deliver the material from one side thereof to wind material on to one of the package tubes and from the other side thereof for winding material on to the other package tube.

One embodiment of the invention will now be described by way of example with reference to the accompanying drawings in which.

Figure 1:
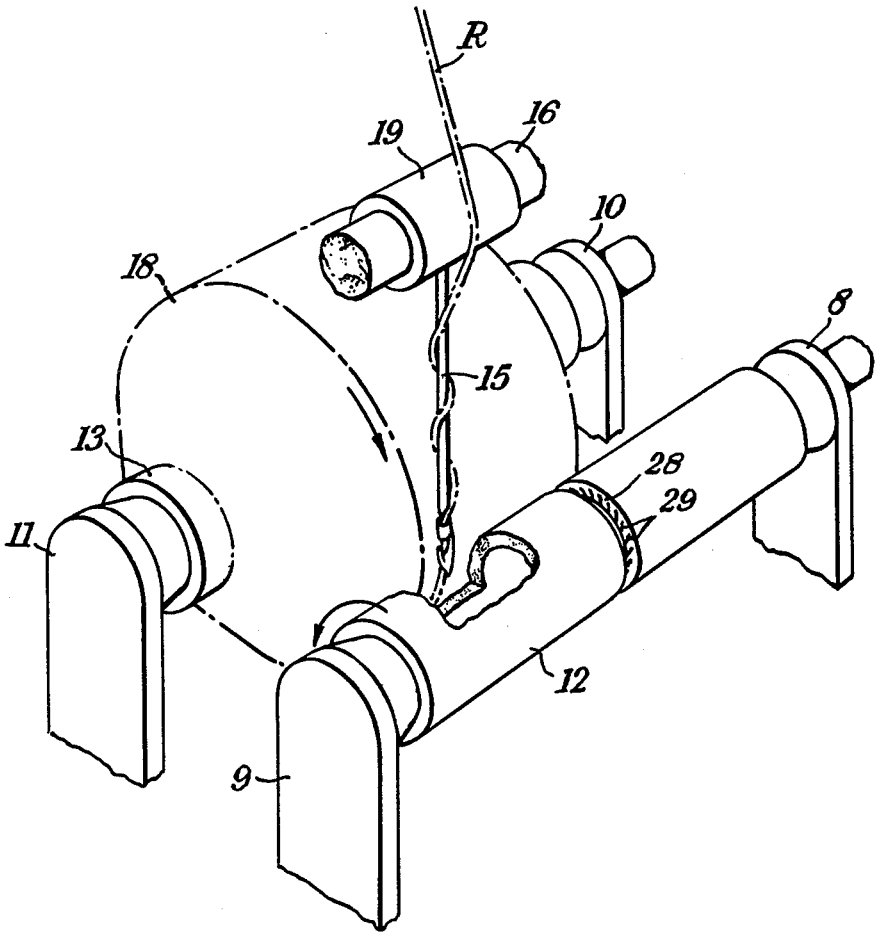
FIG. 1 is a perspective view of a winding arrangement to be driven by a drive mechanism according to the invention and as shown in FIGS. 2 to 4.

One of three identical winding stations is shown in FIG. 1 for winding roving into packages. The station includes two pairs of bobbin mounting members 8, 9 and 10, 11, which are arranged to support package tubes 12 and 13, each pair comprising two stub shafts mounted in spaced coaxial relation and arranged by relative axial movement thereof to enter into supporting engagement with ends of the package tube, the stub shafts co-operating to hold the package tube coaxially therewith for conjoint rotation about a common axis. The package tube 12 can be dropped from the stub shafts by outward axial movement of the stub shafts to enable the replacement of a full package by an empty tube. The package tubes 12 and 13 thus carried by the mounting members 8, 9 and 10, 11 are, as shown, arranged in transversely spaced parallel relation.

The stub shafts of the mounting members 9 and 11 are driven in a manner hereinafter to be described, the stub shaft of the member 9, as viewed from the front in FIG. 1 being rotated in a counter clockwise direction and the stub shaft of the member 11 in a clockwise direction. The speeds of the drives are controlled as hereinafter to be described to ensure that the wind-up of roving on to each package remains at a constant speed taking into consideration the increasing diameter of the roving package.

In order to control the passage of the roving on to the package there is provided for each of the stations a depending delivery arm 15 pivotally supported by a support arm 16.

The delivery arm 15 comprises an elongate cylindrical portion fixed to a boss 19 rotatably mounted on the support arm 16. A roving R passes downwardly from a delivery roller (not shown) over the boss 19 and then around the delivery arm 15 in a number of wraps, finally leaving the arm 15 and being passed immediately on to a package 18 into which the roving is being wound on package tube 13. The arm 15 is formed with a smooth surface to prevent snagging of material being wound. The arm 15 at the end remote from the support arm 16 is so shaped as to control the laying of the roving on to the package, the roving being laid directly under the control of the arm on to the package. Tension is set up in the roving R as it passes to the package 18 to cause the winding-on tension to be sufficiently high to produce a tight package of high density. Furthermore, the roving R is, at any position along its length, prevented by the arm 15 from being under winding tension without sufficient support to prevent an end break.

In a manner hereinafter to be described, the support arm 16 and the delivery arm 15 are subjected to a traverse motion relative to the tube 13 such that the roving is laid in parallel closely positioned wraps around the package tube 13. As will hereinafter be explained, the length of the traverse is gradually decreased as the diameter of the package 18 increases so as to build a double taper package as conventionally built on a speed frame and the traverse rate is decreased as the diameter of the package 18 increases to account for more roving being required to be laid at any one axial position for a complete revolution of the package.

Furthermore, in a manner hereinafter to be described, the diameter of the package being wound is monitored and alters the position of the support arm 16 accordingly, that is, the arm 15 is moved rightwardly as the package increases in diameter and maintains its vertical disposition.

When the diameter of the package 18 being wound reaches a predetermined maximum diameter the arm 15 is moved toward the empty package tube 12 so as to carry the roving R on to the empty tube 12 for winding thereon.

When the left-hand package 18 being wound at each station is sufficiently large, the support arm 16 carrying the arm 15 is moved to a position in which the arm 15 bears against the left-hand side of the empty right-hand tube 12 with the arm 15 lying at an angle of the order of 30° to the vertical. As winding traverse of the arm 15 continues, the roving is drawn across the surface of the empty package tube 12 while being wound upon the full package. The spacing of the package tubes 12 and 13 is so arranged that the package being built, when filled, almost contacts the surface of the empty package tube, whereby the winding of the roving on to the package continues without danger of breaking the roving.

The empty package tube 12 as shown in FIG. 1 has at a position along its length a circumferential groove 28 of rectangular cross-section with teeth 29 turned inwardly and in one direction around the circumference. In use, the empty package tube 12 is arranged such that the teeth 29 project in the direction of rotation, in this case counterclockwise. Thus, when the roving encounters the groove 28, it enters it and is caught by the teeth 29 to commence winding on the empty package tube. As the full package 18 and the empty package tube 12 are rotating in opposite directions the roving R is pulled sufficiently to break it without removing it from the groove 28. In this way, winding continues on the empty package tube 12 and the full package 18 is free to be doffed and replaced by a fresh emtpy package tube.

Immediately winding of roving on to the empty package tube 12 commences, tension in the roving tends to pull the roving from the side it occupies in building the package on the tube 13 to the opposite side, that is to say, the side adjacent the package tube 12 on which a new package is being wound. The roving thus slips to the other side provided the direction of traverse is such as to tend to pull it over the end of the arm. If the direction of traverse is opposite to this, the roving will not move to the other side until the direction of traverse alters.

The arm 15 is symmetrical with respect to a plane perpendicular to the plane including the axes of the packages so as to be able to direct roving on to the left-hand or right-hand package.

Figure 2:
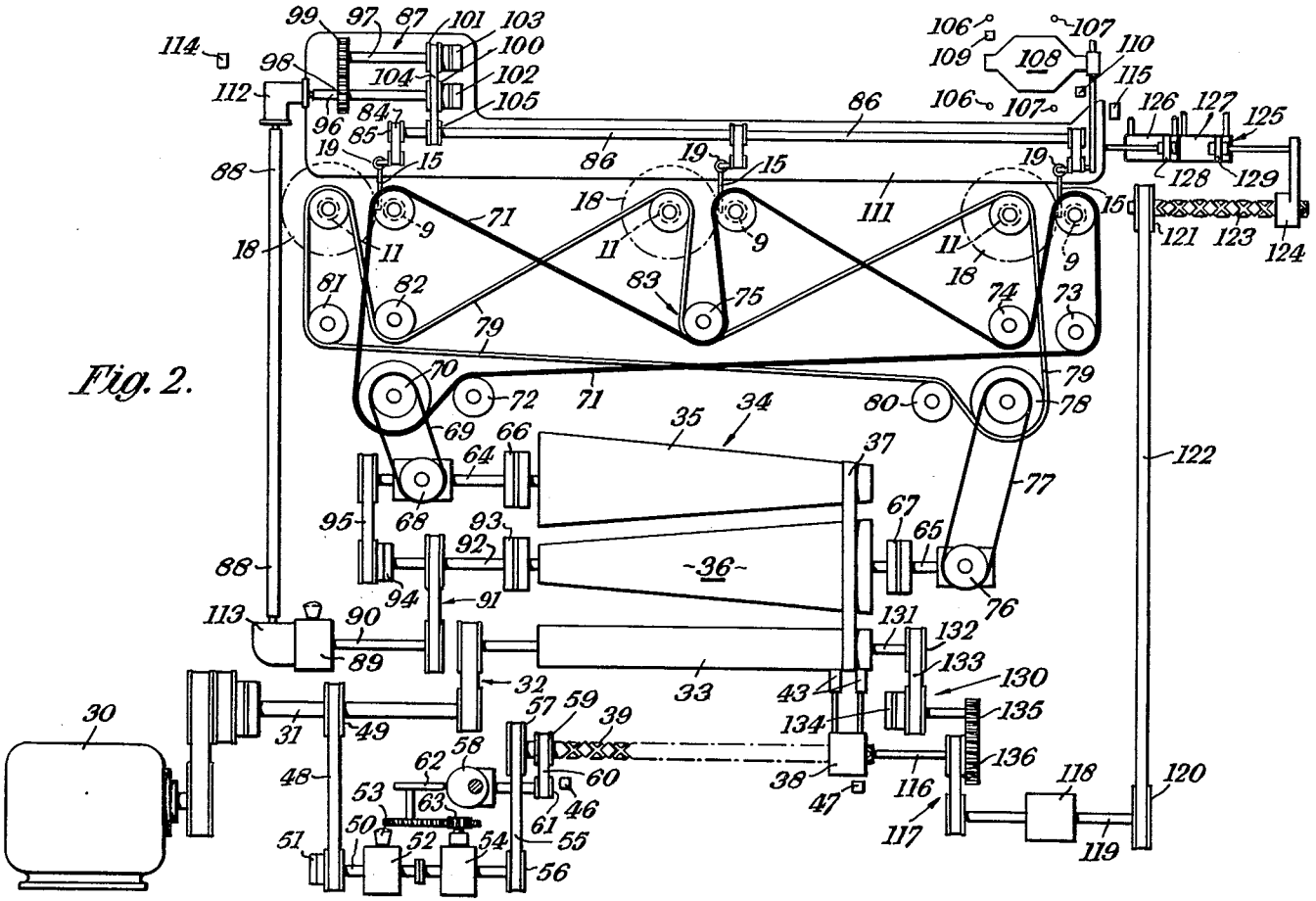
FIG. 2 is a schematic side elevation of a drive mechanism according to the invention.
Figure 3:
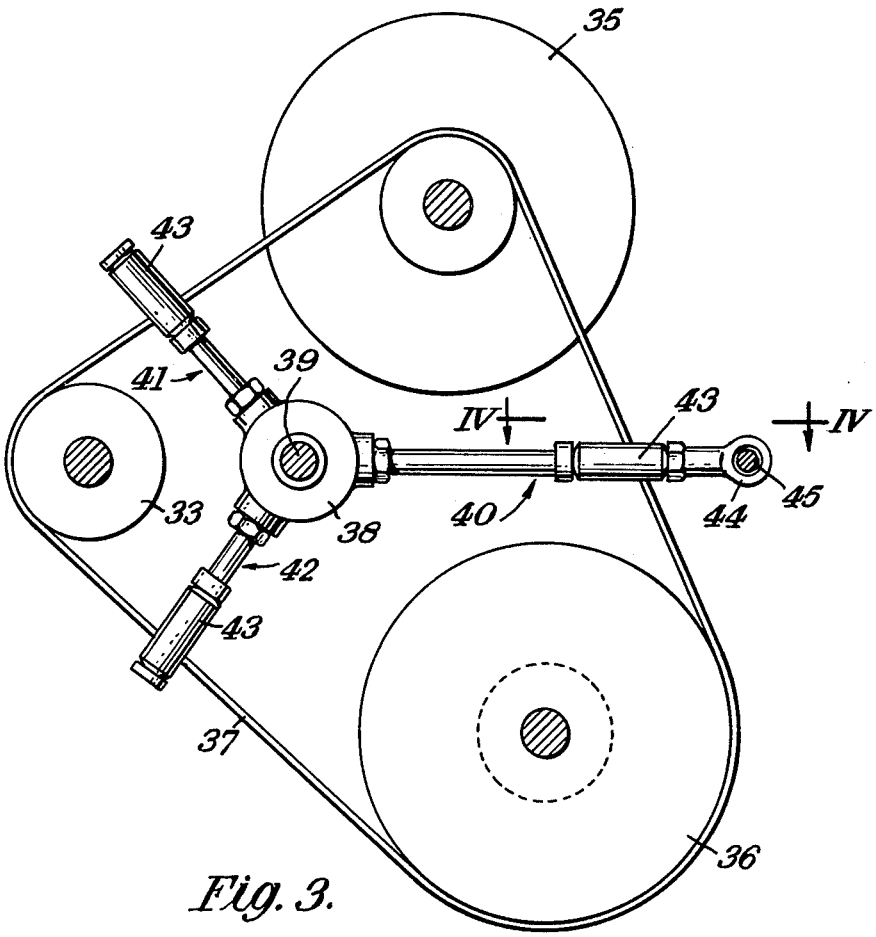
FIG. 3 is an end view of part of the drive mechanism illustrated in FIG. 2, drawn to an enlarged scale.
Figure 4:
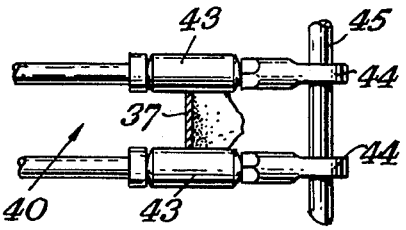
FIG. 4 is a plan view of part of the mechanism shown in FIG. 3, taken on the line IV—IV in FIG. 3.

A drive system for driving the package tube mounting members 8, 9 and 10, 11, at the three winding stations, at appropriate variable speeds, for traversing the delivery arms 15 in the direction of the package tube axes at a variable rate to produce properly wound parallel-build packages and for displacing the arms 15 in a direction at right angles to the package tube axes to take account of the increases in diameter of the packages being built, as well as for further displacing the arms 15 to bring them into roving-transfer engagement with the empty bobbin tubes will now be described with reference to FIGS. 2 to 4.

In the drive system shown in FIGS. 2 to 4, a main drive motor 30 drives a main drive shaft 31 which in turn drives via a pulley and belt system 32 the input drive roller 33 of a cone drive system 34. The system 34 comprises the roller 33 which is cylindrical and a pair of identical cone pulleys 35 and 36 formed by straight sided frusto-cones with their apexes facing in opposite directions. While for convenience of illustration in FIG. 2 the cone pulleys 35 and 36 and the roller 33 are shown one above another, they are in fact arranged, as shown in FIG. 3, with their axes located at the apexes of a triangle, a drive belt 37 being wrapped around them under sufficient tension to communicate drive from the roller 33 to the pulleys 35, 36. As the pulleys 35, 36 are of identical shape the distance around the roller and pulleys in planes perpendicular to the axis of the roller are substantially the same, whereby the belt 37 can be readily moved parallel to the axes of the pulleys without forming slack or becoming overtaut.

As indicated schematically in FIG. 2, a follower 38 carried by a scroll 39 effects motion of the belt 37 along the axes of the pulleys 35 and 36. In FIG. 2, the follower 38 and scroll 39 are for convenience of illustration shown below the drive roller 33, but are in fact and as shown in FIG. 3 located within the triangular configuration formed by the roller 33 and the cone pulleys 35 and 36.

As best seen in FIG. 3, the follower 38 carries three pairs of arms 40, 41, 42 for engaging the belt. The pairs of arms 40, 41, 42 are arranged as shown in FIG. 3 at predetermined angular spacings around the axis of the scroll 39 and each arm carries a roller 43, with the arms of each pair spaced such that the associated rollers engage opposite edges of the belt 37. The pair of arms 40 is arranged to engage the belt conveniently at an intermediate point between the pulleys and then extend beyond the belt as best seen in FIG. 4, with each arm terminating in a ring 44 engaging a rod 45 which prevents rotation of the follower 38 about the axis of the scroll 39. In this way, rotation of the scroll 39 will cause the belt 37 to traverse the length of the roller 33 and pulleys 35 and 36, the direction of motion being changed automatically at the ends by reversal of the direction of lead of the thread of the scroll. Limit switches 46 and 47 are for a purpose hereinafter to be described provided for indicating when the follower 38 reaches respective ends of the scroll 39.

Drive to the scroll 39 is taken from the drive shaft 31 by a belt 48 engaging a pulley 49 on the shaft 31. The belt drives a shaft 50 via a clutched pulley 51, the shaft 50 serving as the input to an infinitely variable 'H' gear box 52, which serves as a reduction gear box and variation of which is effected by a manually operable control knob 53. Output from the gear box 52 passes through a second infinitely varible 'H' gear box 54 and via a belt 55 and pulleys 56 and 57 to the scroll 39. The variation of the second 'H' gear box is effected by a cam 58. The cam 58 is driven by the scroll 39 via pulleys 59, 60 and belt 61 in such a way that it rotates once for each traverse of the follower 38 along the scroll 39. The cam 58 effects the variation of the gear box 54 via a drive bar 62 and a rack and pinion arrangement 63.

The variation provided by the gear box 54 and the cam 58 enables a more complex motion to be given to the follower 38 by the scroll 39 than the constant speed motion provided when the gear box 54 and cam 58 are omitted or rendered ineffective. In certain circumstances it has, however, been found that the gear box 54 and the cam 58 can be omitted and that the simple constant speed motion is acceptable.

The cone pulleys 35, 36 communicate drive to drive shafts 64, 65 via clutches 66, 67. The drive shaft 64 communicates drive via a pulley 68, a belt 69 and a drive wheel 70 to a drive tape 71 which is guided over four guide pulleys 72 to 75 and which drives the bobbin tube mounting and drive members 9 supporting bobbin tubes 12 at each winding position. Similarly, the shaft 65 communicates drive via a pulley 76, belt 77, drive wheel 78 to a drive tape 79, which is guided by guide pulleys 80 to 83 and which drives the bobbin drive tube mounting and drive members 11 supporting bobbin tubes 13 at each winding position.

The clutches 66, 67 enable the drive members 9, 11 to be stopped when it is desired to doff a package, in order that the package is stationary when doffed, and the leave the bobbin which is not being filled stationary.

The package build traversing movement of the arms 15 to wind the roving in parallel wound arrangement is produced by a tape drive shown only schematically in FIG. 2. Each arm 15 is pivotally carried by its support arm 16 which is fixedly mounted on a tape 84 mounted on pulleys (not shown) for longitudinal reciprocating motion in the direction of the bobbin tube axis. The tape 84 is drivably engaged by a pulley 85 fixed on a shaft 86, which is caused to rotate alternately in opposite directions by controlled amounts and at controlled speeds.

The shaft 86 receives its controlled drive, via a reversing mechanism 87, explained hereinafter, from a shaft 88 which is in turn driven, via an adjustable gear 89, a shaft 90, a pulley and belt arrangement 91, from a shaft 92. The shaft 92 is driven either by the cone pulley 36 via a selectively operable clutch 93, or by the cone pulley 35, via a selectively operable clutch 94, belt and pulley arrangement 95 and the shaft 64, in dependence upon whether winding is taking place upon the bobbin tubes 13 or on the tubes 12. In this way, the shaft 86 is driven at a speed proportional to the rotational speed of the bobbin tube on which winding is taking place and hence proportional to the diameter of the package being formed. Therefore, as the diameter of the package grows, the speed of traversing decreases to accommodate the increase in the circumference of the package and to maintain constant the spacing between adjacent turns of the roving.

The reversing mechanism 87 comprises a first shaft 96 receiving drive from the shaft 88 and a second shaft 97, the shafts carrying meshing gear wheels 98, 99 whereby the shaft 97 is driven in opposite direction to the shaft 96. The shafts 96, 97 carry pulleys 100, 101, which can be keyed to the shaft for corotation on operation of clutches 102, 103. The pulleys 100, 101 communicate drive via a belt 104 to a pulley 105 on the shaft 86. In this way, depending upon which of the clutches 102 or 103 is operated, the shaft 86 will be driven in the same direction as the shaft 88 or in the opposite direction thereto. Switching of the clutches 102, 103 thus controls the package build traversing movement and is effected by two pairs of sensors 106, 107 which cooperate with a template 108 carried by one of the arms 15 in such a way that it carries out package build traversing motion therewith. For the convenience of illustration, the arrangement of the sensing devices 106 and 107 and the template 108 have been shown in FIG. 2 as appearing in the plane of the paper. They are of course in fact arranged in a horizontal plane with the template moving horizontally and not vertically as illustrated. The first pair of sensors 106 cooperate with one side of the shaped template 108 and the other pair 107 with the other side. An additional pair of sensors 109, 110 are positioned at the sides of the template 108, as shown, for a purpose that will be explained hereinafter. The sensors 106, 107, 109 and 110 are held stationary on the machine main frame so that the template moves relative to them.

The arms 15, the shaft 86, the reversing mechanism 87 and the template 108 are all carried upon a cartridge 111 whereby they are moved together to accommodate increases in package diameter. For this reason, the shaft 88 is coupled at its ends by universal joints 112, 113 to allow the shaft 88 to take up this motion. Switches 114 and 115 are positioned at respective ends of the carriage 111 to indicate when the carriage reaches a position immediately before the full extent of its travel, as will be explained in more detail hereinafter.

As mentioned hereinbefore, the follower 38 is controlled by the scroll 39 to vary the speed of the drive members 9 and 11 and in dependence upon the diameter of the package at any instant to control winding, and hence its motion is dependent upon package diameter. Thus the amount of rotation of the scroll 39 is dependent upon package diameter.

In order to control the carriage 111 so as to move the arms 15 such that they remain vertical and tangential to the package at any instant, the motion of the scroll 39 is communicated via a drive shaft 116, belt and pulleys 117, reduction gear 118, drive shaft 119, pulleys 120, 121 and belt 122 to a second scroll 123 with a follower 124. The scrolls 39 and 123 are arranged such that during the time the follower 38 traverses from one end to the other, the follower 124 similarly traverses from one end to the other and accordingly its motion is also dependent upon the diameter of the package being wound.

The carriage 111 is moved by the follower 124 (via a transfer mechanism 125 explained hereinafter) and hence the arms 15 are moved in dependence upon the diameter of the package and are retained in the correct position for winding, that is, vertical and tangential to the package.

The transfer mechanism 125 comprises a pair of back-to-back pneumatic cylinders 126, 127 with pistons 128, 129. The piston 129 is attached to the follower 124 and the piston 128 to the carriage 111. Air supply to both sides of each piston is provided whereby the carriage can be moved an additional amount in either direction over and beyond the travel provided by the scroll 123 and follower 124 for the purposes of transferring winding from one bobbin to the other.

In operation of the device, in conditions (not as shown) where winding of roving has just commenced upon bobbins 13 supported by the drive members 11, the belt 37 is arranged (not as shown) at the left hand end of the roller 33, that is to say, the follower 38 is arranged at the left hand end of the scroll 39 having just reversed direction.

Similarly, the follower 124 is arranged at the left hand end of the scroll 123 such that the arms 15 are at the left hand end of their traverse, that is to say, adjacent the surface of the bobbin tubes on the drive members 11. Clutches 66 and 94 are declutched whereby the drive members 9 are stationary and the shaft 92 is driven by the cone pulley 36 via the engaged clutch 93. Sensors 107 are activated and sensors 106 deactivated such that pulses are emitted from the former only.

As the belt 37 engages the narrow end of the cone pulley 36, the pulley 36 and hence the bobbin drive members 11 are driven at their maximum speed, which is so correlated with the delivery speed of the roving that the surface speed of the bobbin is equal to the delivery speed of the roving, thereby providing the correct conditions for wind-up of the roving. Rotation of the drive shaft 31 to drive the pulley 36 and bobbin drive members 11 also causes rotation of the scroll 39 via the gear boxes 52 and 54 at a speed very much less than that of the pulley 36 whereby the follower 38 and hence the belt 37 are moved along the pulley 36 toward the right hand end. This causes the speed of the pulley 36 and the bobbin drive members 11 to decrease until at the position shown in FIG. 2 the belt 37 is at the right hand end of the pulley 36 and the drive members 11 are driven at their slowest speed.

Rotation of the drive shaft 92 causes the arms 15 to traverse the packages on the bobbin drive members 11 to build up the first layer of roving in parallel turns. At the same time, the template 108 is traversed between the pairs of sensors 106, 107. The shape of the template is so chosen that it defines the required tapered shape of the package and at the position of commencement of winding the activated sensors 107 cooperate with the narrowest part of the template 108. In this way, the template and hence the arms 15 move the maximum distance from one sensor 107 before the template triggers the other sensor 107, the triggering of each sensor reversing the condition of the two clutches 102 and 103 and thereby reversing the direction of traverse of the arms 15.

As the scroll 39 is rotated, the scroll 123 rotates similarly and moves the follower 124 from the left hand end towards the right in dependence upon package diameter, whereby the arms 15 remain vertical and tangential to the packages being formed on the bobbins carried by drive members 11. Additionally, the template 108 is moved transversely relative to the sensors 107 so as to present gradually widening surfaces to the sensors. In this way, the extent of the traverse between reversals is gradually reduced to produce an end-tapered parallel-build package.

Furthermore, as the scroll 39 is rotated the speed of the cone 36 decreases and therefore the speed of the shaft 86 decreases to reduce the traverse speed of the arms 15.

For winding of the roving to take place correctly, the surface speed of the packages at any diameter must be equal to the delivery speed of the roving and to provide this condition adjustment of the gear box 50 must be made in dependence upon the count and material of the roving supplied. Thus adjustment is made to ensure that the rate of rotation of the scroll 39 is such that the follower 38 reaches the right hand end at the time when the packages are full.

As the roving delivery speed is constant, the surface speed of the packages, within small limits, must remain similarly constant. The surface speed is dependent upon the diameter of the packages and the angular speed of the packages is dependent upon the position of the follower 38 on the scroll 39 and hence the follower 38 must be moved by the scroll such that it follows the increase in diameter of the packages. If the rate of increase in diameter is linear, the rate of motion of the follower 38 between the extreme left and right hand positions must also be linear whereupon no adjustment of the gear box 54 is necessary. If some departure from a linear condition is necessary then this is accommodated by a suitable choice of shape for the cam 58.

Thus, the adjustment for the gear box 52 and the shape of the cam 58 is set before commencement of winding to ensure correct winding of the roving on the packages, that is to say, to retain the tension substantially constant throughout the package build.

When the followers 38 and 124 have reached the right hand ends of the scrolls 39 and 123 (as shown in FIG. 2), the packages of roving on the bobbins supported by the drive members 11 are full and the machine is ready for transfer of the rovings to the bobbin supported by drive members 9. In this position the arms 15 are very closely adjacent the positions to be taken by empty bobbins on the drive members 9.

Immediately before the follower 38 reaches the end of the scroll 39 the carriage 111 operates the switch 115 of the pair of switches 114 and 115, which activates a mechanism (not shown) for supplying bobbins to the drive members 9. At the next reversal point of the traverse mechanism as sensed by the sensors 107 a pulse is supplied by the sensor 107 to the main motor 30 to slow the machine to the order of one quarter of normal machine speed, to facilitate the transfer procedure. Following the reversal point, the follower 38 reaches the end of the scroll 39, which is sensed by the switch 47 of the pair of switches 46 and 47, which acts to stop the rotation of the scroll 39 by declutching the clutched pulley 51. This prevents the follower 38 commencing its reverse journey before transfer has taken place.

At the next reversal point as sensed by the sensors 107, air is supplied to the right hand side of piston 129 in the cylinder 127 to move the carriage 111 further to the right by an amount equal to the piston stroke. This causes the arms 15 to rest against the empty bobbins on the drive members 9, leaning at an angle to the vertical as their traverse motion continues. The bobbin, as hereinbefore explained, is provided with groove 28 and teeth 29 to pick-up the roving and to commence winding on the empty bobbin, thus breaking the roving between the full package and the empty bobbin.

Immediately the traverse motion has passed the pick-up groove 28, which is sensed by one of a pair of switches 109, 110, cooperating with the template 108, the carriage 111 is returned by the supply of air to the left hand side of the piston 129.

At the return, the machine speed is returned to full operation and the building motion is changed to operate in respect of the bobbin drive members 9. This achieved by restarting the scroll 39 to commence the return journey of the follower 38 and the follower 124, by declutching the clutch 93 and engaging clutches 66 and 94, whereby the shaft 92 and hence the traverse motion is driven via the clutch 94 by the cone 35, and by activating the pair of sensors 106 associated with the other side of the template 108 and deactivating the sensors 107. At this time also, the full packages on the drive members 11 are removed. The building of packages on bobbins on the drive members 9 then continues in a symmetrical manner until transfer back to winding on bobbins on the drive members 11, which takes place in a symmetrical manner to the transfer just described.

It is found desirable to make provision for very rapid traversal of the mechanisms hereinbefore described with reference to FIG. 2 when a bad package is formed and it becomes necessary to remove it and restart the winding on the next empty bobbin. This is achieved in the arrangement shown in FIG. 2 by an override drive 130 which transmits drive from an output shaft 131 of the roller 33 via a pulley 132, a belt 133 and a clutched pulley 134 to meshing gears 135 and 136 the latter of which is driveably fixed on the shaft 116 of the scroll 39. Upon the appearance of a bad package the clutched pulley 51 is declutched and the clutched pulley 134 is engaged, whereby a high speed drive from the roller 33 is transmitted to the scrolls 39 and 123 to bring the followers 38 and 124 rapidly to their end positions on the scrolls, whereupon transfer of the winding of roving onto the empty bobbins takes place as hereinbefore described and the bad package or packages removed.

In an alternative arrangement (not shown) the scroll 39 is replaced by a screw with a reversal in the direction of motion of the follower 38 being obtained by reversing the direction of rotation of the screw.

In yet another alternative arrangement (not shown) the scroll 39 is rotated in discrete steps so as more closely to follow the build up of the packages. This may be achieved by a pneumatic cylinder/piston which turns a sprag clutch driving the scroll, and which is driven in dependence upon pulses received from the sensors 106, 107.

I claim:

1. Apparatus for winding an elongate fibrous material, comprising, package tube mounting means to support first and second package tubes in winding positions, a material delivery means for delivering material first to one of the package tubes to form a first package and then to the other of the package tubes to form a second package, and variable speed drive means for rotating the package tubes, said variable speed drive means comprising a first output drive member for driving one of the package tubes, a second output drive member for driving the other of the package tubes, a constant speed input member, a drive transfer mechanism for transmitting drive from said input member to the output drive members throughout a predetermined range of complementary drive ratios and control means responsive to a predetermined control input progressively to adjust the drive transfer mechanism to vary the complementary drive ratios in said range to produce a gradual reduction in speed of one of the two output drive members with a corresponding increase in the speed of the other output drive member followed by a gradual reduction in speed of the said other of the two output drive members with a corresponding increase in the speed of the said one of the output drive members.

2. Apparatus according to claim 1, wherein said control means is such as to produce in response to said control input a constant rate of change of speed of said output drive members throughout said range of drive ratios.

3. Apparatus according to claim 1, wherein said control means includes cam means to provide in response to said control input a predetermined variation in the rate of change of speed of the output drive members within said predetermined range of drive ratios.

4. Apparatus according to claim 1, wherein said control means is selectively responsive to said control input or an auxiliary control input for rapidly adjusting the drive transfer mechanism to a position corresponding to package completion.

5. Apparatus according to claim 1, wherein said control means includes manually adjustable means for adjusting the control input to provide for the winding of materials of different characteristics.

6. Apparatus for winding an elongate fibrous material, comprising, package tube mounting means to support first and second package tubes in winding positions, material delivery means for delivering material first to one of the package tubes to form a first package and then to the other of the package tubes to form a second package, and variable speed drive means for rotating the package tubes, said variable speed drive means comprising a first output drive member for driving one of the package tubes, a second output drive member for driving the other of the package tubes, a cylindrical drive roller, a pair of cone pulleys arranged in transversely spaced parallel relationship with the smaller diameter of each opposite the larger diameter of the other, means for connecting one of the cone pulleys to said first output drive member and means for connecting the other of the cone pulleys to said second output drive member, a belt passing in driven contact with the drive roller and in driving contact with the two cone pulleys and means for traversing the belt along the drive roller and along the two cone pulleys to produce a gradual reduction in speed of one of the two output drive members with a corresponding increase in the speed of the other output drive member followed by a gradual reduction in speed of the said other of the two output drive members with a corresponding increase in the speed of the said one of the output drive members.

7. Apparatus according to claim 6, comprising, first traversing means for causing relative traversing movement between each package tube and the delivery means in the direction of the axis of rotation of the tube for building a parallel-build package on the tube, said first traversing means being drivably connected to one of the output drive members of the variable speed drive means during the build of a package on one of the package tubes and being drivably connected to the other of the output drive members of the variable speed drive means during the build of a package on the other of the package tubes and second traversing means operative during the building of each package to cause in a direction perpendicular to the axes of rotation of the tubes a relative displacement between the delivery means and the package tube to accommodate the increasing diameter of the package being built on the tube, said second traversing means being drivably connected to the control means of said variable speed drive means.

8. Apparatus according to claim 7, wherein said first traversing means includes reversing means for reversing the direction of traverse of the delivery means at each end of its traverse in the direction of the package tube axis, said reversing means comprising first switch means to reverse the direction of traverse of the delivery means at one end of the traverse, second switch means to reverse the direction of traverse of the delivery means at the other end of the traverse and switch operating means for operating said first and second switch means, said first and second switch means and said switch operating means being arranged for relative movement in the direction of the package tube axis corresponding to the relative traversing movement between the delivery means and the package tube in the direction of the package tube axis and being arranged for further relative movement in a direction perpendicular to the package tube axis corresponding to the relative displacement between the delivery means and the package tube, and wherein said first and second switch means and said switch operating means are so shaped as to provide predetermined changes in the length of traverse during the build of the package.

9. Apparatus for winding an elongate fibrous material, comprising, package tube mounting means to support a plurality of package tubes in winding positions, and means for driving the package tubes comprising a cylinderical drive roller, a pair of cone pulleys arranged in transversely spaced parallel relationship with the smaller diameter of each opposite the larger diameter of the other, a belt passing in driven contact with the drive roller and in driving contact with two cone pulleys, and means for traversing the belt along the drive roller and the cone pulleys.

* * * * *